United States Patent [19]

Lopez-Crevillen et al.

[11] 4,394,853

[45] Jul. 26, 1983

[54] ENGINE OIL PAN ISOLATION MOUNTING

[75] Inventors: Jose M. Lopez-Crevillen, Westland; John W. Huber, Plymouth, both of Mich.

[73] Assignee: General Motors Corporation, Detroit, Mich.

[21] Appl. No.: 275,739

[22] Filed: Jun. 22, 1981

[51] Int. Cl.[3] ..... F02F 7/00

[52] U.S. Cl. ..... 123/195 C; 181/204; 184/106

[58] Field of Search ..... 123/195 R, 195 C, 198 E, 123/90.38, 90.37; 181/204; 184/6.5, 106

[56] References Cited

U.S. PATENT DOCUMENTS 1,737,466 11/1929 Lynd ..... 184/106
3,540,425 11/1970 Scheiterlein et al. ..... 123/195 R
4,059,085 11/1977 Mansfield et al. ..... 123/195 R
4,067,531 1/1978 Sikula ..... 123/198 E

FOREIGN PATENT DOCUMENTS 2723459 1/1978 Fed. Rep. of Germany ... 123/195 C
2431651 2/1980 France ..... 123/195 C

*Primary Examiner*—Craig R. Feinberg
*Attorney, Agent, or Firm*—Robert J. Outland

[57] ABSTRACT

An engine oil pan is mounted in noise reducing vibration isolation from the associated engine by a mounting arrangement including a unitary resilient seal having lips that extend under the oil pan flange to retain the seal in assembly with the pan both during and after assembly of the pan to the engine block. Separate support members interconnect spacer sleeves that extend through gripping openings in the seal and limit compression of the seal by oil pan attaching bolts so as to maintain the vibration isolating qualities of the seal in assembly.

3 Claims, 5 Drawing Figures

ENGINE OIL PAN ISOLATION MOUNTING

TECHNICAL FIELD

This invention relates to engine oil pans and mountings therefor and more particularly to a sound isolating seal and oil pan mounting arrangement for an engine.

BACKGROUND

It has been suggested in the art relating to internal combustion engines, including diesel engines, that the sound or noise radiated from operating engines both in and out of vehicles may be reduced by various means, such as stiffening portions of the engine structure, enclosing portions of the engine with sound absorbing or intercepting shields or covers and/or attaching various exterior components of the engine structure, such as cylinder head covers and oil pans, by sound isolating mounting means. Some proposed arrangements involve penalties in added cost and reduced serviceability of the engine or its installation as well as, in some cases, making assembly of the engine more difficult.

SUMMARY OF THE INVENTION

The present invention provides an improved engine and oil pan isolation mounting arrangement that utilizes a novel one-piece soft resilient seal with an appropriately designed oil pan and associated components to provide a sound isolating mounting and seal arrangement capable of simple low cost assembly. These and other features of the invention will be more fully understood from the following description of a preferred embodiment taken together with the accompanying drawings.

DETAILED DESCRIPTION

Figure 1:
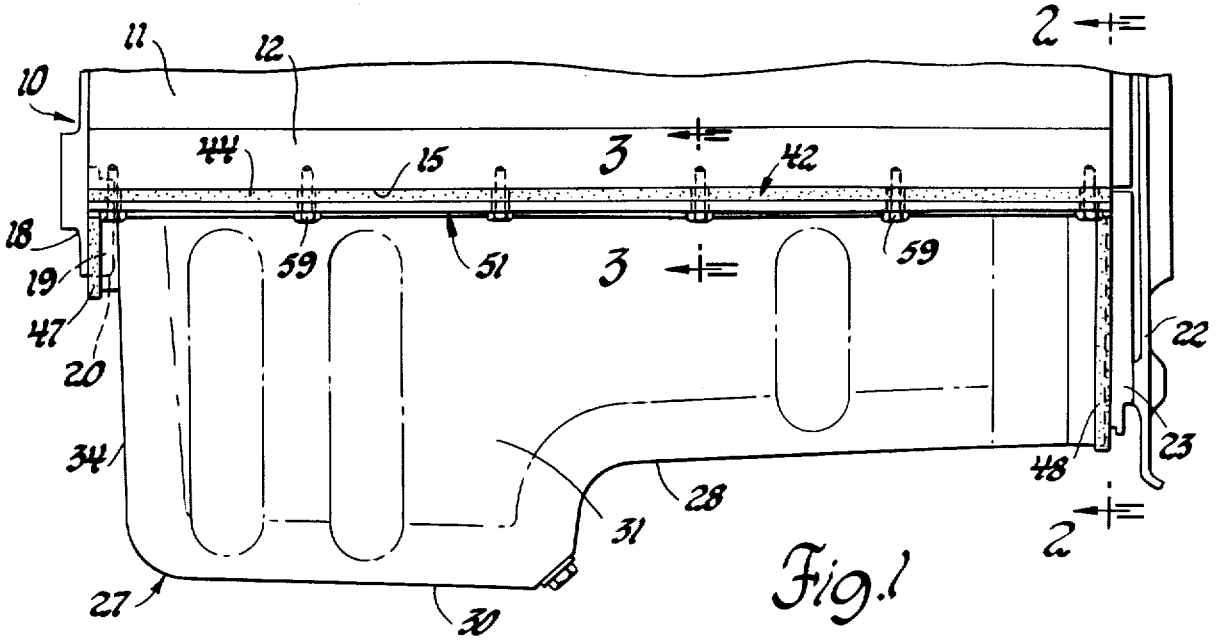
FIG. 1 is a side elevational view of the lower portion of a diesel internal combustion engine having an oil pan seal and isolation mounting arrangement formed in accordance with the present invention.

Referring now to the drawings in detail, numeral 10 generally indicates an engine of the diesel internal combustion type, representative of engines to which an oil pan may be applied. Engine 10 includes a cast block 11 partially defining a crankcase and including side walls 12, 14 terminating downwardly in longitudinally extending generally parallel side rails having downwardly facing oil pan receiving sealing surfaces 15, 16.

At one end the cylinder block carries a front end plate 18 that supports on its inner side a front adapter 19. The adapter extends laterally between the side rails and has a downwardly facing sealing surface 20. This surface laterally connects the side rail surfaces 15, 16 and is downwardly curved intermediate the rails to provide clearance for the end of the engine crankshaft, not shown, to extend through the end plate 18.

At its other end, the block 11 carries a rear end plate 22 on the inner side of which is mounted a rear oil pan adapter 23. Adapter 23 includes a forwardly extending flange 24 having a downwardly facing surface 26 that laterally connects the side rails 15, 16 in a downwardly extending curve. Side rail surfaces 15, 16 and adapter surfaces 20 and 26 together form downwardly facing sealing surfaces comprising an oil pan receiving peripheral surface.

Engine 10 is further provided with an oil pan 27, preferably made of formed sheet steel. The steel is drawn to define an open topped downwardly closed container having a bottom 28 including a deeper sump portion 30 and connecting with upwardly extending side walls 31, 32 and a front end wall 34, all terminating upwardly in a peripheral flange 35. The flange includes spaced generally parallel side portions 36, 38 which extend outwardly from the upper edges of the side walls 31, 32 respectively to define upper surfaces and are adapted to be placed in sealing engagement with the downwardly facing side rail surfaces 15, 16 of the engine block.

The oil pan flange 35 further includes a front end portion 39 which extends outwardly from the upper edge of the front end wall 34 and includes a downwardly curved portion intermediate its ends to define an upper surface shaped correspondingly to the lower surface 20 of the front adapter 19 in order to permit a relationship of sealing engagement between them. The flange 35 also includes a rear end portion 40 which extends outwardly in a downwardly curved configuration from the oil pan bottom and side walls 28, 31 and 32 to define an upper surface having generally the shape of the downwardly facing surface 26 of the rear adapter 23 to allow a relationship of sealing engagement between them. The upper surfaces of portions 36, 38, 39 and 40 of the oil pan peripheral flange 35 together define an upwardly facing oil pan peripheral surface.

In accordance with the invention, the engine is provided with a unitary resilient vibration absorbing seal 42 attachable to the oil pan flange to provide for sealing engagement of the oil pan peripheral surface with the downwardly facing peripheral surface of the crankcase forming block and adapter elements. Seal 42 is preferably formed of a low durometer elastomer, such as silicone, having substantial resilience to make it capable of absorbing vibrations.

The seal 42 includes an upper sealing portion 43 which, in assembly, extends along and is clamped between the oil pan flange top peripheral surface and the crankcase peripheral surface. The seal further includes peripheral retaining and isolating lips 44, 46, 47, 48 which depend respectively from the side rail and end member engaging portions of the seal upper sealing portion. The lips lie beneath the oil pan flange over extended portions of its periphery to retain the seal 42 in assembly with the oil pan both during and after its installation on the engine block. Lips 47, 48 of the seal end portions have a relatively short length of extension below the outer edges of the oil pan flange, while lips 44, 46 which cooperate with the side rail portions of the pan extend laterally inwardly the full width of the flange and include short downwardly depending portions 50 for a purpose to be subsequently made clear.

To provide for retention of the oil pan and seal on the engine block so as to enclose the lower side of the crankcase, there are provided a pair of longitudinally extending support members 51 having horizontal walls 52 terminating laterally in upwardly extending outer stiffening flanges 54 and downwardly extending inward stiffening flanges 55. Sleeves 56 are projection welded to the walls 52 to extend upwardly at spaced locations. The sleeves 56 define openings 58 to receive securing bolts 59 threadably engageable with threaded openings 60 provided in the block side rails. Cooperating openings 62 are provided in the side rail portions of the seal 42 sized to grip the sleeves of the support members. Corresponding openings 63 of larger diameter are provided in the side portions of the oil pan flange to permit entry of the support member sleeves with clearance to avoid engagement therewith.

With an oil pan and crankcase configuration as described, it is preferable that the lips 44, 46 of the seal side portions and lip 47 of the front end portion form a continuous peripheral lip in order both to provide a seal structure of substantial strength and to provide for its positive securing to the oil pan flange. It is, however, within the contemplation of the invention to form the lips of intermittent lengths along the periphery of the oil pan flange as may be adequate to provide the desired retention and strength in various applications. It will be noted that the side portion lips 44, 46 terminate with open ends at the rear end of the pan seal leaving a space between them and the ends of lip 48. The latter preferably extends continuously along the rear end portion of the seal except at its end locations for reasons which will be subsequently described.

To assemble the engine and oil pan assembly of the present invention, the seal 42 is first assembled to the oil pan flange. This may be accomplished by placing the seal upon the pan flange, the seal being offset slightly in the direction of the front of the pan from its assembled position. The lips 44, 46 are then resiliently deformed to snap them around the side portions of their respective oil pan flange portions. The seal is then slid rearwardly to its assembled position wherein lip 47 slides under the edge of the flange front end portion 39, thus retaining the front portion of the seal in assembly with the pan. Thereafter, lip 48 is resiliently deformed and snapped around the rear end portion 40 of the oil pan flange, completing assembly of the seal to the pan so that it is positively retained in place during subsequent handling of the pan during assembly.

Preferably the support members 51 are then assembled to the pan and seal assembly by forcing the sleeves 56 through the openings 62 and 63 until the horizontal walls 52 and the flanges 54 and 55 engage the lips 44, 46 and the depending portions 50. As previously mentioned, the sizing of the openings 62 in the seal is preferably such as to grip the sleeves 56, thus retaining the support rails in place after they have been assembled to the seal and oil pan assembly.

Subsequently, the oil pan, seal and support member assembly is placed in position on the engine block with the seal upper surfaces in engagement with the crankcase downwardly facing peripheral surface. Bolts 52 are then installed through each of the sleeve openings 58 to secure the pan assembly to the block. In tightening the bolts, the sleeves 56 limit the compression of the seal to a predetermined amount so that the resilient vibration isolating qualities of the seal are preserved.

Installation of the pan to the block is preferably done with the engine block in an inverted position so that the pan and seal assembly may simply be placed in position on the block before being secured thereto. It is, however, possible to install the pan from below the block in the manner outlined above if desired.

Figure 2:
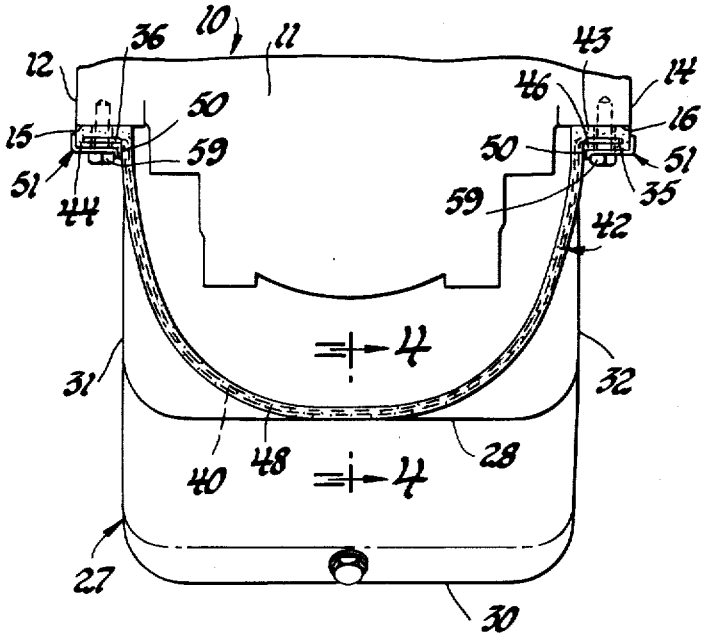
FIG. 2 is a cross-sectional view of the engine from one end of the oil pan and seal assembly as seen from the plane indicated by the line 2—2 of FIG. 1.
Figure 3:
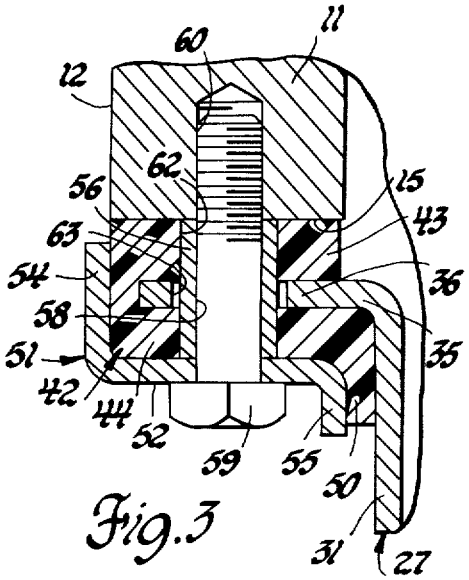
FIG. 3 is an enlarged cross-sectional view at one of the oil pan attaching bolts in the plane of the line 3—3 of FIG. 1.
Figure 4:
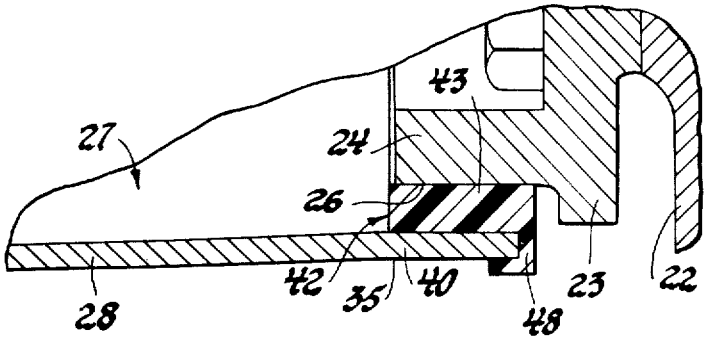
FIG. 4 is a cross-sectional view through one of the transverse sealing portions viewed from the plane indicated by the line 4—4 of FIG. 2.
Figure 5:
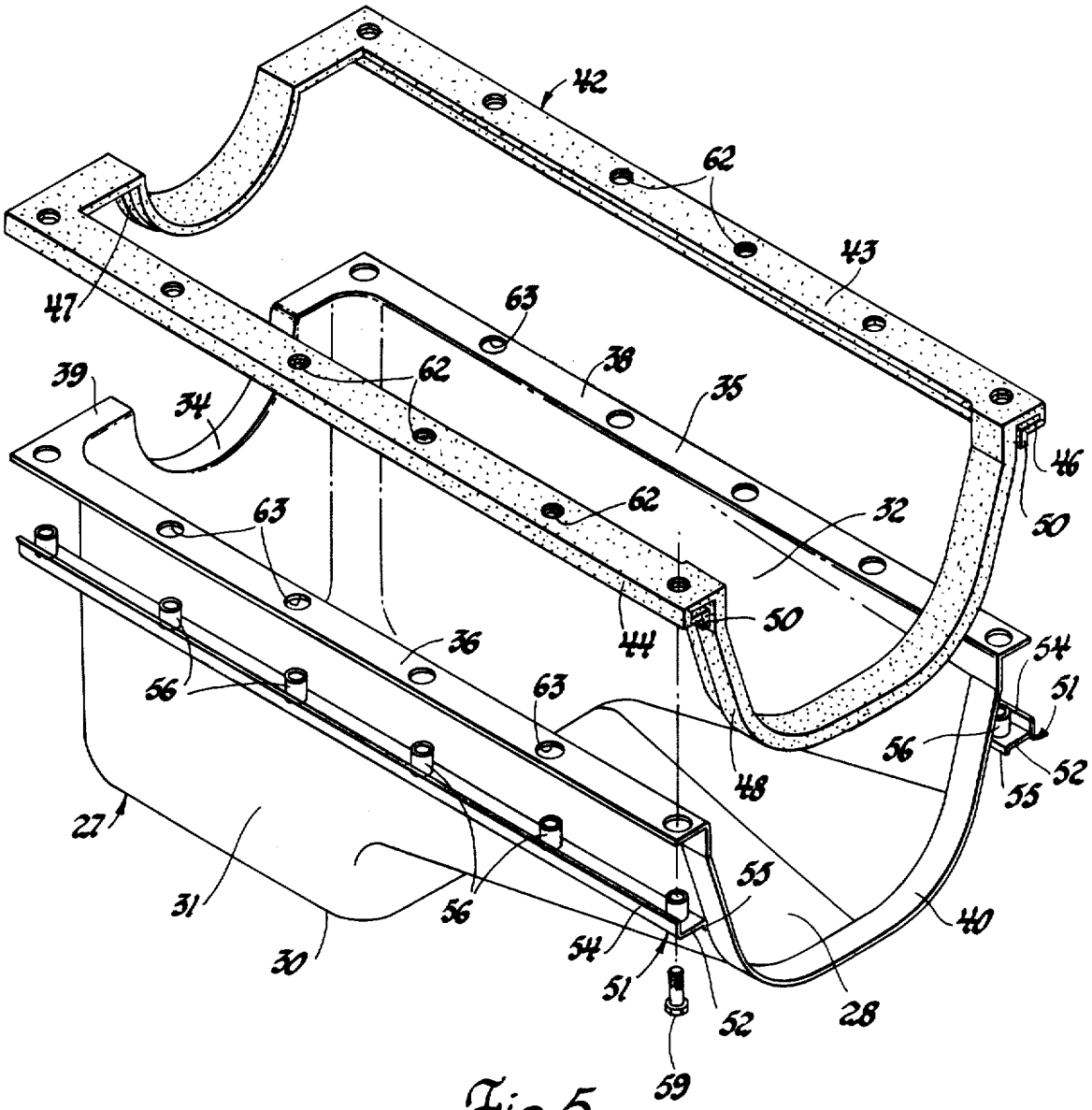
FIG. 5 is a pictorial view showing the various components of the oil pan seal and mounting assembly.

When the oil pan seal, and support member assembly has been secured to the block, as shown in FIGS. 1–4 of the drawings, the oil pan is completely supported by the seal 42 and is maintained in complete isolation from metal to metal contact with the block and the end adapters as well as from the support rails and the securing bolts which are in contact with the engine block. Thus, the oil pan flange is maintained in sealing engagement with the peripheral surface of the crankcase defining elements, but is isolated therefrom by the sealing member so as to substantially reduce the transfer of vibration from the block to the oil pan and thus minimize the transmission of noise from the oil pan walls to the engine exterior. This advantage is provided by a simple, but effective, one-piece seal which is easily installed and yet positively maintained in place on the oil pan so as to provide for easy assembly of the pan to the engine in either the upright or inverted position.

The depending portions 50 of the seal lips separate the inner flanges 55 of the support members from engagement with the side walls of the oil pan and the enlarged openings 63 in the flange side portions provide clearance to avoid contact of the flange with the sleeves 56. If desired, more positive separation could be provided by O-rings or grommets placed in the flanged openings.

While the invention has been described by reference to a preferred embodiment chosen for purposes of illustration, it should be understood that numerous changes could be made without departing from the inventive concepts described. Accordingly, it is intended that the invention not be limited to the described embodiment but that it have the full scope permitted by the language of the following claims.

The embodiments of the invention in which an exclusive property or privilege is claimed are defined as follows.

1. In combination in a combustion engine, a crankcase having a pair of laterally spaced longitudinally extending generally parallel side rails connected laterally at their ends by end elements, said side rails and end elements having downwardly facing sealing surfaces comprising an oil pan receiving surface and fastener receiving openings through said side rail sealing surfaces, an oil pan defining an open topped downwardly closed container with a peripheral flange extending laterally outward from open upper edges of the container, said flange having a top surface sealingly engageable with the oil pan receiving surface and spaced parallel side portions supportingly attached to said crankcase side rails, said side portions having openings aligned with said side rail openings, a resilient vibration absorbing seal attached to said flange, said seal having an upper sealing portion extending along and clamped between said flange top surface and said oil pan receiving surface and peripheral retaining and isolating lips depending from said upper sealing portion and extending beneath said flange to secure the seal on the flange prior to assembly to the crankcase, said seal having openings through said sealing portion and said lips and aligned with said crankcase side rail openings and said oil pan side portion openings, and securing means, including fasteners engaging said side rails and abutting support members engaging said seal isolating lips and urging said lips against the oil pan flange, to compress a predetermined limited amount the seal upper sealing portion between the flange and the oil pan receiving surface and the seal lips between the flange and the support members to thereby maintain sound isolating sealing enegagement between the oil pan and the crankcase and sound isolating engagement between the oil pan and the securing means, said support members including sleeves extending through said seal and oil pan openings and engaging said crankcase side rails to limit compression of said seal, said fasteners extending through said sleeves to said side rails, said oil pan openings being large enough to avoid engagement with said sleeves and said seal openings being small enough to grip the sleeves upon assembly of the support members with the seal and oil pan to retain these members together for assembly to the crankcase.

2. In combination in a combustion engine, a crankcase having a pair of laterally spaced longitudinally extending generally parallel side rails connected laterally at their ends by end elements, said side rails and end elements having downwardly facing sealing surfaces comprising an oil pan receiving peripheral surface, and fastener receiving openings through said side rail sealing surfaces, an oil pan formed from sheet metal to define an open topped downwardly closed container with a peripheral flange extending laterally outward from the open upper edges of the container, said flange having a peripheral top surface sealingly engageable with the oil pan receiving peripheral surface and spaced parallel side portions supportingly attached to said crankcase side rails, said side portions having openings aligned with said side rail openings, a resilient vibration absorbing seal attached to said flange and having an upper sealing portion extending along and clamped between said flange top surface and said oil pan receiving peripheral surface and peripheral retaining and isolating lips depending from said upper sealing portion and extending beneath said flange to secure the seal on the flange prior to assembly to the crankcase, said seal having openings through said sealing portion and said lips and aligned with said crankcase side rail openings and said oil pan side portion openings, and securing means including fasteners engaging said side rails and abutting support members engaging said seal isolating lips and urging said lips against the oil pan flange to compress a predetermined limited amount the seal upper sealing portion between the flange and the oil pan receiving peripheral surface and the seal lips between the flange and the support members to thereby maintain sound isolating sealing engagement between the oil pan and the crankcase and sound isolating engagement between the oil pan and the securing means, said support members including sleeves extending through said seal and oil pan openings and engaging said crankcase side rails to limit compression of said seal, said fasteners extending through said sleeves to said side rails, said oil pan openings being large enough to avoid engagement with said sleeves and said seal openings being small enough to grip the sleeves upon assembly of the support members with the seal and oil pan to retain these members together for assembly to the crankcase.

3. The combination of claim 2 wherein said seal retaining lips are discontinuous at corners adjacent one end of the oil pan to permit installation by sliding the seal on the flange side portions to position the lip on another end and then positioning the lip at said one end by deforming and snapping it around the flange at said pan one end.

* * * * *